US011213844B2

(12) United States Patent
Ciavarella

(10) Patent No.: US 11,213,844 B2
(45) Date of Patent: Jan. 4, 2022

(54) PUMPS WITH SELF-ADJUSTING VOLUMES, REFILL UNITS AND DISPENSERS HAVING SAME

(71) Applicant: GOJO Industries, Inc., Akron, OH (US)

(72) Inventor: Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 16/801,641

(22) Filed: Feb. 26, 2020

(65) Prior Publication Data

US 2020/0269266 A1 Aug. 27, 2020

Related U.S. Application Data

(60) Provisional application No. 62/810,687, filed on Feb. 26, 2019.

(51) Int. Cl.
*B05B 11/00* (2006.01)
*A47K 5/12* (2006.01)

(52) U.S. Cl.
CPC ..... *B05B 11/3087* (2013.01); *A47K 5/1207* (2013.01); *B05B 11/3061* (2013.01)

(58) Field of Classification Search
CPC .... G01F 11/021; G01F 11/023; G01F 11/024; G01F 11/04; G01F 11/06; G01F 11/20;
(Continued)

(56) References Cited

U.S. PATENT DOCUMENTS 1,362,077 A * 12/1920 Bobrick ..... A47K 5/1205 222/309
3,458,090 A * 7/1969 Scoggin, Jr. ..... G01F 11/06 222/309

(Continued)

FOREIGN PATENT DOCUMENTS

| | | | |
|---|---|---|---|
| EP | 1266696 | A1 | 12/2002 |
| WO | 20171023945 | A1 | 2/2017 |
| WO | 2017103158 | A1 | 6/2017 |

OTHER PUBLICATIONS

International Search Report and Written Opinion from PCT/US2020/019905 dated May 28, 2020.

*Primary Examiner* — Paul R Durand
*Assistant Examiner* — Randall A Gruby
(74) *Attorney, Agent, or Firm* — Calfee, Halter & Griswold LLP

(57) ABSTRACT

Exemplary embodiments of pumps, refill units and dispenser systems are disclosed herein. An exemplary refill unit for a soap, sanitizer or lotion includes a container for holding a fluid and a pump secured to the container. The pump includes a housing, a liquid piston, a liquid pump chamber, an air piston, an air pump chamber; and a piston holder. The liquid piston is connected to the air piston. The piston holder is connected to one of the liquid piston and the air piston. The connection comprises one or more projections and one or more grooves. The volume of the liquid pump chamber and the air pump chamber both change as a function of the engagement of the one or more projections with the one or more grooves.

20 Claims, 4 Drawing Sheets

(58) Field of Classification Search
CPC .. G01F 11/22; B05B 11/3087; B05B 11/3061; B05B 11/3085; B05B 11/3088; A47K 5/14; A47K 5/1207
USPC ..... 222/309, 190, 321.7–321.9, 372, 383.1, 222/385
See application file for complete search history.

(56) References Cited

U.S. PATENT DOCUMENTS 3,556,353 A * 1/1971 Echols ..... G01F 11/06 222/309
5,411,181 A * 5/1995 Knickerbocker ... B05B 11/3008 222/309
6,257,458 B1 * 7/2001 Green ..... B67D 7/0205 222/321.9
8,074,844 B2 * 12/2011 Ophardt ..... B05B 11/00 222/309
8,851,331 B2 * 10/2014 Pelkey ..... G01F 11/023 222/181.3
8,955,718 B2 2/2015 Ciavarella et al.
9,062,667 B2 * 6/2015 Ophardt ..... B05B 11/3008
9,220,377 B2 * 12/2015 Fitzpatrick ..... A47K 5/1205
11,040,365 B2 * 6/2021 Lee ..... B05B 11/3087
11,092,472 B2 * 8/2021 Ophardt ..... F04B 17/00
2004/0149777 A1 * 8/2004 Santagiuliana ..... B05B 11/3023 222/190
2009/0200341 A1 * 8/2009 Oden ..... B05B 11/3007 222/309
2011/0017778 A1 * 1/2011 Kadiks ..... A47K 5/1217 222/190
2011/0127298 A1 * 6/2011 Shah ..... G01F 11/028 222/309
2012/0308405 A1 * 12/2012 McNulty ..... A47K 5/1207 417/62
2015/0114997 A1 * 4/2015 Uldry ..... B05B 11/3007 222/309
2017/0035257 A1 * 2/2017 Moore ..... B05B 7/0025
2017/0055782 A1 * 3/2017 Ophardt ..... A47K 5/1207
2019/0001358 A1 * 1/2019 Lee ..... B05B 11/3008
2020/0113392 A1 * 4/2020 Ophardt ..... A47K 5/1207
2020/0269266 A1 * 8/2020 Ciavarella ..... A47K 5/1207
2020/0292366 A1 * 9/2020 Ophardt ..... F04B 13/00
2020/0384488 A1 * 12/2020 Knight ..... B05B 11/3087

* cited by examiner

PUMPS WITH SELF-ADJUSTING VOLUMES, REFILL UNITS AND DISPENSERS HAVING SAME

RELATED APPLICATIONS

The present application claims the benefits of, and priority to, U.S. Provisional Patent Application No. 62/810,687, which is titled PUMPS WITH SELF-ADJUSTING VOLUMES, REFILL UNITS AND DISPENSERS HAVING SAME, which was filed on Feb. 26, 2019 and which is incorporated by reference herein in its entirety.

TECHNICAL FIELD

The present invention relates generally to fluid dispenser systems and more particularly to pumps with self-adjusting volumes. fluid dispensers, and refill units having the same.

BACKGROUND OF THE INVENTION

Liquid dispenser systems, such as liquid soap and sanitizer dispensers, provide a user with an amount of liquid upon actuation of the dispenser. In some circumstances, users desire dispensers to dispense less than a full dose of fluid. In many cases, the dispensers are modified so that the dispenser dispenses less then a full dose of fluid by reducing the length of stroke of the actuator, which "short strokes" the pump. Unfortunately, short stroking the pump often results in the pump failing to prime and/or inconsistencies in the volume of pump output. Attempts have been made to overcome the priming issues by altering the volume of the liquid chamber, see e.g. U.S. Pat. No. 9,062,667 titled Variable Volume Bore Piston Pump, or causing "lost motion" in the return stroke, see e.g. U.S. Pat. No. 8,955,718 titled Foam Pumps with Lost Motion and Adjustable Output Foam Pumps. These systems may suffer from disadvantages such as, for example, inconsistencies in volumes of air to liquid and/or noise and/or additional wear to parts. In some prior art systems, pump valving is made more complex and expensive due to added parts or features. Further some of these prior art systems waste energy with every activation due to lost motion needed to reset the pump to its at rest position.

SUMMARY

Exemplary embodiments of pumps, refill units and dispenser systems are disclosed herein. An exemplary refill unit for a soap, sanitizer or lotion includes a container for holding a fluid and a pump secured to the container. The pump includes a housing, a liquid piston, a liquid pump chamber, an air piston, an air pump chamber; and a piston holder. The liquid piston is connected to the air piston. The piston holder is connected to one of the liquid piston and the air piston. The connection comprises one or more projections and one or more grooves. The volume of the liquid pump chamber and the air pump chamber both change as a function of the engagement of the one or more projections with the one or more grooves.

Another exemplary refill unit for a soap, sanitizer or lotion includes a container for holding a fluid and a pump secured to the container. The pump has a housing, a liquid piston, a liquid pump chamber, an air piston, an air pump chamber, and a piston holder. The liquid piston is connected to the air piston. One or more projections on one of the piston holder and the liquid piston or air piston and one or more grooves on one of the piston holder and the liquid piston or air piston are also included. The volume of the air pump chamber and the volume of the liquid pump chamber are determined by the position of the one or more projections with respect to the one or more grooves.

An exemplary dispenser system includes a dispenser. The dispenser has an actuator that has an actuator drive stroke length. The drive stroke length may be set at one or more drive stroke lengths to dispense one or more different volumes of fluid. A refill unit for a soap, sanitizer or lotion is also included. The refill unit includes a container for holding a fluid and a pump secured to the container. The pump has a housing, a liquid piston, a liquid pump chamber, an air piston, an air pump chamber, and a piston holder. The liquid piston is connected to the air piston. One or more projections are on one of the piston holder and the liquid piston or air piston. One or more grooves are on one of the piston holder and the liquid piston or air piston. The volume of the air pump chamber and the volume of the liquid pump chamber are determined by the position of the one or more projections with respect to the one or more grooves which is determined by the one or more drive stroke lengths of the dispenser.

An exemplary pump includes a housing, a liquid piston, a liquid pump chamber, an air piston, an air pump chamber and a piston holder. The liquid piston is connected to the air piston. The piston holder is movably connected to one of the liquid piston and the air piston. The movable connection comprises one or more first members and one or more second members. The one or more first members engage with the one or more second members in at least two positions. The volume of the liquid pump chamber and the air pump chamber in a first position are less than the respective volumes of the liquid pump chamber and the air pump chamber in a second position.

BRIEF DESCRIPTION OF THE DRAWINGS

These and other features and advantages of the present invention will become better understood with regard to the following description and accompanying drawings in which.

DETAILED DESCRIPTION

Figure 1:
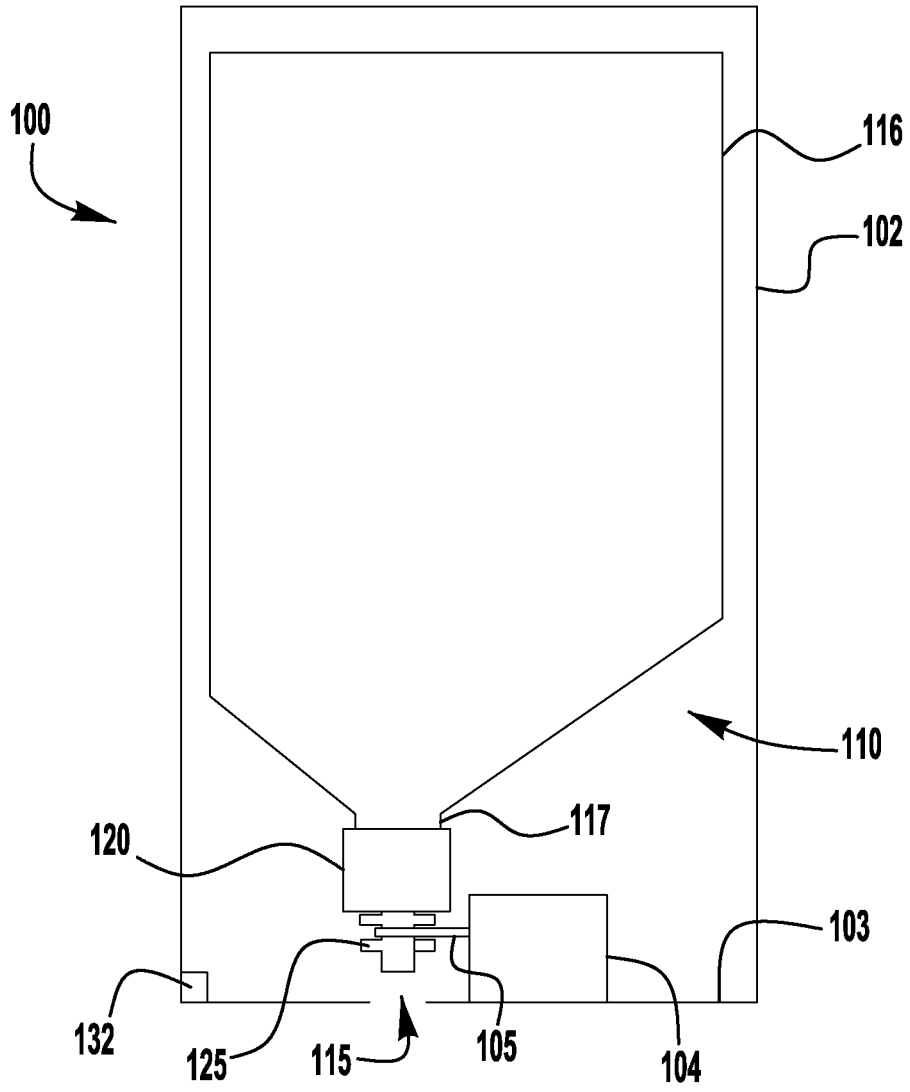
FIG. 1 is a cross-section of an exemplary liquid dispenser having a refill unit with a pump having a self-adjusting volume output.

FIG. 1 is a schematic view of an exemplary embodiment of a dispenser 100 with a vertically operated pump 120. (FIG. 1 is a cross-section taken through the housing 102 to show the pump 120 and container 116). Dispenser 100 includes a disposable refill unit 110. The disposable refill unit 110 includes a container 116 having a neck 117 connected to pump 120. The dispenser 100 may be a wall-mounted dispenser system, a counter-mounted dispenser system, an un-mounted portable dispenser system movable from place to place or any other kind of fluid dispenser system. In this particular embodiment, dispenser 100 is a foam dispenser; however, the inventive pumps having self-adjusting volumes disclosed herein may be used in liquid dispenser systems as well. In addition, although embodiments contain vertically actuated pumps, the inventive system works equally well with other types of pumps, such as, for example, horizontally actuated pumps.

In this exemplary embodiment, the container 116 forms a liquid reservoir that contains a supply of foamable liquid within the disposable refill unit 110. In various embodiments, the contained liquid could be, for example, a soap, a sanitizer, a cleanser, a disinfectant, a lotion or the like. In the exemplary embodiment of a disposable refill unit 110, the container 116 is a collapsing container and can be made of thin plastic or like material. The container 116 may be refillable, replaceable or both refillable and replaceable. In some embodiments, the liquids may be non-foamable or non-foaming liquids. In some embodiments, the container 116 is a non-collapsing container, and in such cases, a venting valve (not shown) or venting mechanism may be used to vent the bottle to prevent or reduce collapsing of the bottle.

In the event the liquid in the container 116 of the installed disposable refill unit 110 runs out, or the installed refill unit 110 otherwise has a failure, the installed refill unit 110 may be removed from the foam dispenser 100. The empty or failed disposable refill unit 110 may then be replaced with a new disposable refill unit 110.

The housing 102 of the dispenser 100 contains one or more actuating members 104 to activate the pump 120. As used herein, actuator or actuating members or mechanisms include one or more parts that cause the dispenser 100 to move liquid, air and/or foam from container 116 out of outlet nozzle 125. Actuator 104 is generically illustrated because there are many different kinds of pump actuators which may be employed in the foam dispenser 100. The actuator 104 of the foam dispenser 100 may be any type of actuator, such as, for example, a manual lever, a manual pull bar, a manual push bar, a manual rotatable crank, an electrically driven, or motor driven actuator or other means for actuating the pump 120. In this exemplary embodiment, dispenser 100 has an electrically activated actuator 104. Dispenser 100 may include an optional sensor 132 for detecting the presence of an object and to provide for a hands-free dispenser system with touchless operation. Various intermediate linkages may also be included, such as for example linkage 105 which connects the actuator member 104 to the pump 120 within the system housing 102. An aperture 115 is located in bottom plate 103 of housing 102 and allows fluid to be dispensed from the nozzle 125 of pump 120 to a user.

In this exemplary embodiment, actuator 104 may be configured to dispense a plurality of different dose sizes or dispense volumes. In this exemplary embodiment, the different dose sizes or volumes dispense correspond to different actuation drive lengths (i.e. drive distances or stroke lengths) of the actuator 104. In this exemplary embodiment, the longer the drive length or stroke length of the actuator 104, the greater the dispense volume. FIGS. 3-8 illustrate exemplary embodiments of pumps that may be used in conjunction with the above described exemplary dispensers to dispense four different dose sizes (i.e. four actuator drive lengths or stroke lengths). More or less than four different dose sizes may be utilized in accordance with the teachings herein with slight modifications. In some embodiments, the dose size, i.e. actuator drive length is determined by the manufacturing facility. In some embodiments, the dose size, i.e. actuator drive length is manually set. In some embodiments, the dose size, i.e. actuator drive length is automatically set by, for example, the dispenser 102 reading indicia from the refill unit 110 and automatically setting the dose size, i.e. actuator drive length as a function of the indicia read from the refill unit 110.

Figure 2:
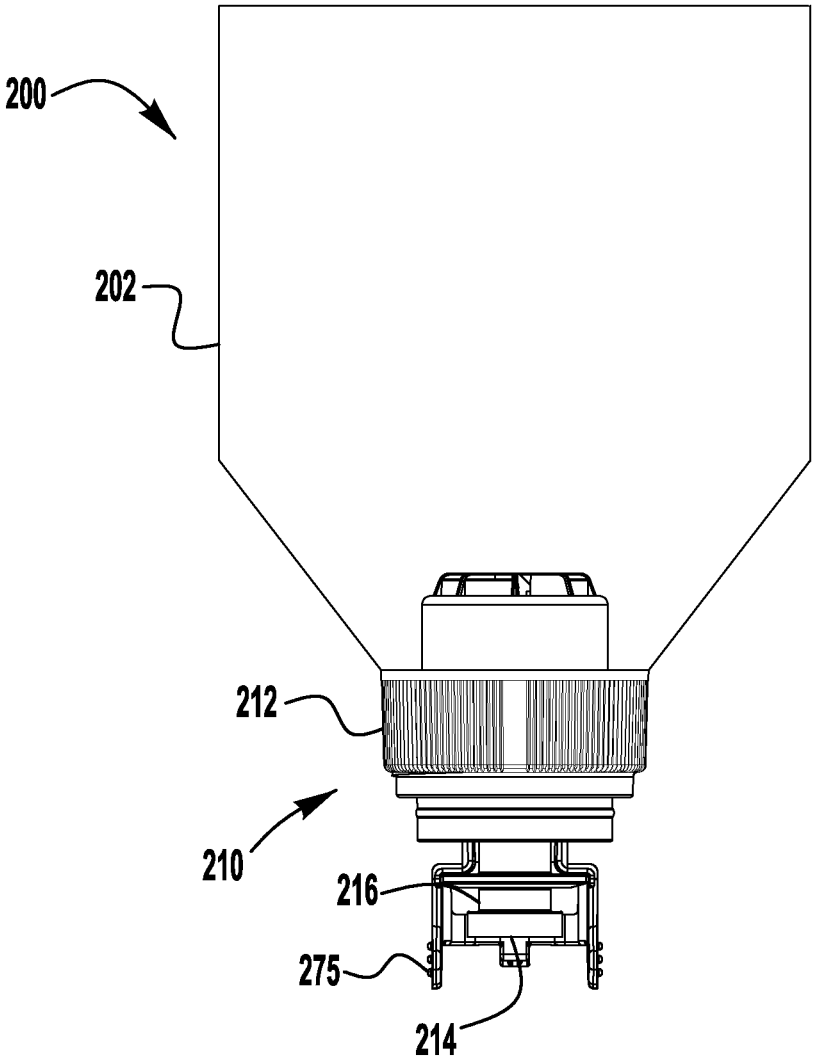
FIG. 2 is a cross-section of an exemplary embodiment of a refill unit with a pump with a self-adjusting volume output.

FIG. 2 is a partial cross-section of an exemplary embodiment of refill unit 200 and a portion of an actuator linkage 275. Refill unit 200 may be used in conjunction with dispenser 100. Refill unit 200 includes a container 202 and a foam pump 210. Foam pump 210 is secured to container 202 by closure 212. Foam pump 210 includes a piston 216 and an outlet nozzle 214.

Figure 3:
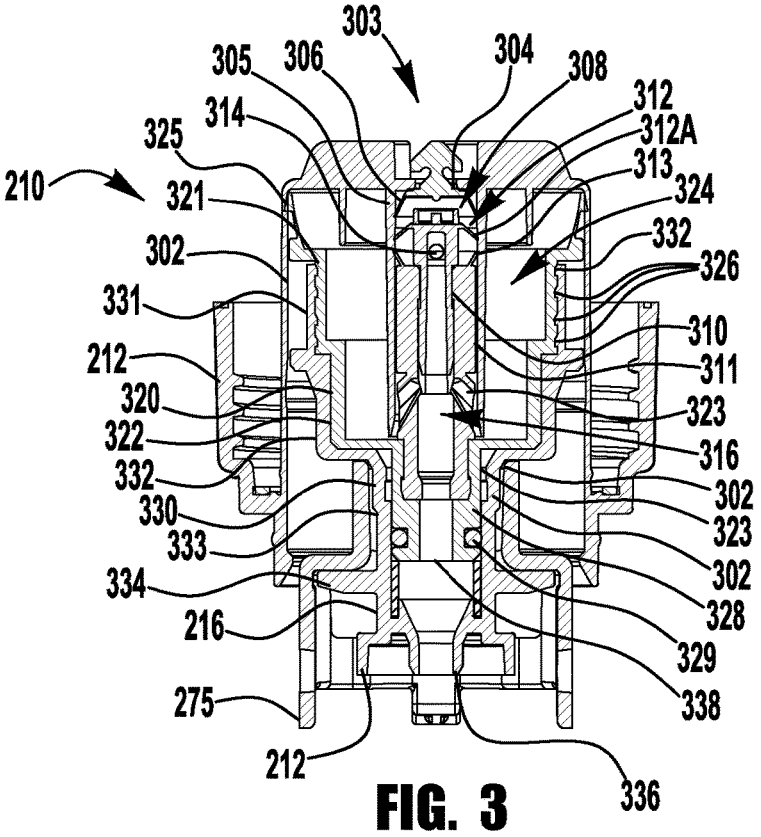
FIG. 3 is a cross section of the pump with a self-adjusting volume output.

FIG. 3 is a cross-sectional view of the foam pump 210 and actuator 275. Actuator 275 is preferably part of a dispenser (not shown) and not included with the pump. Actuator 275, and is shown herein to illustrate how the actuator grips the pump piston. Foam pump 210 includes a housing 302. Located within pump housing 302 is a cylindrical wall 305 that forms part of a liquid pump chamber 308 as described below. Foam pump 210 includes a liquid inlet 303. Located within the liquid inlet 303 is a liquid inlet valve 304. Liquid inlet valve 304 has a wiper seal 306 that engages cylindrical wall 305. In this exemplary embodiment, liquid inlet valve 304 is a wiper valve, however, inlet valve 304 may be any type of one-way valve, such as for example, a wiper valve, ball and spring valve, an umbrella valve, a flapper valve or the like A liquid piston 310 reciprocates within the cylindrical wall 305. Liquid piston 310 has a liquid outlet valve 312 located proximate its inner end. In this exemplary embodiment, liquid outlet valve 312 is a wiper valve, however, liquid outlet valve 312 may be any type of one-way valve, such as for example, a wiper valve, ball and spring valve, an umbrella valve, a flapper valve or the like. A pump chamber 308 is formed by liquid inlet valve 304, liquid outlet valve 312, and cylindrical wall 305.

Liquid pump piston 310 reciprocates back and forth increasing and decreasing the volume of liquid pump chamber 308. Liquid pump piston 310 includes liquid outlet valve 312. Liquid outlet valve 312 has a wiper seal 312A. Wiper seal 312A is opposed to wiper seal 313, that is liquid flows past the wiper seals 312A and 313 in different directions. In addition, liquid pump piston 310 has a hollow shaft and one or more apertures 314 which are located between the opposed wiper seals 312A, 313. Apertures 314 allow liquid to flow from the liquid pump chamber 308 into the center of the liquid pump piston 310 toward outlet 336.

Foam pump 210 also includes an air pump chamber 324 and an air pump piston 320. Air pump piston 320 is connected to liquid pump piston 310 and accordingly, the two pistons 320, 310 move together. Air pump piston 320 includes a wiper seal 325 that rides against the inside wall of housing 302 to compress air in air chamber 324. Liquid pump piston 310 includes one or more air inlet apertures 323. Foam pump 210 includes two mix media 338, such as for example screens, that cause liquid flowing from foamable liquid container 202 through liquid pump piston 310 and air flowing from air pump chamber 324 through aperture 323 to mix together to form a rich foam. Other mix media, such as, for example, a porous member, one or more sponges, a plurality of baffles, or the like, may be used.

In addition, foam pump 210 includes an annular projection 334 for engaging with actuator linkage 275, which is connected to the dispenser (not shown) to move the liquid piston 310 and air piston 320 upward to dispense foam and downward to recharge the air pump chamber 324 and liquid pump chamber 308. In this exemplary embodiment, air pump chamber 324 is recharged by drawing in air through the outlet nozzle 336 and air outlet aperture 323. Drawing air in through the outlet nozzle 336 also sucks back residual foam and fluid to help prevent dripping after dispensing a dose of foam.

In this exemplary embodiment, the air piston 320 connects to a piston holder 330. Piston holder 330 releasably connects to actuator linkage 275 to operate pump 210. In this exemplary embodiment, piston holder 330 includes one or more projection members 332. In this exemplary embodiment, air piston 320 includes one or more grooves 326 sized to receive the one or more projections 332. In some embodiments, the one or more projections are located on the air piston 320 and the one or more grooves are located on piston holder 330. Preferably the one or more grooves 326 are arranged to provide for desired dose sizes. In some embodiments, the projection members 332 are annular projection members. In some embodiments, the projection members 332 have a sloped or serrated surface which allows the piston holder 330 to move easier in one direction with air piston 320 and not as easy in the opposite direction. On some embodiments, the one or more grooves 326 are annular grooves.

Figure 4:
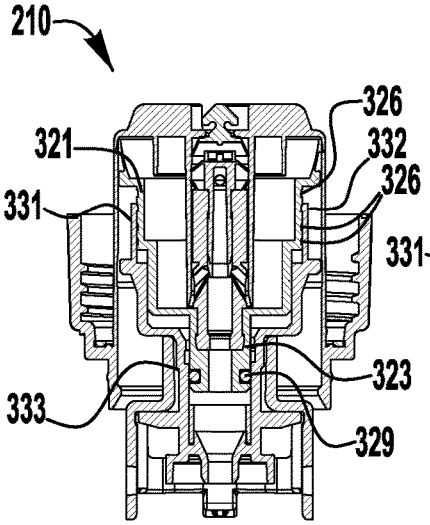
FIGS. 4-6 illustrate the pump of FIGS. 2 and 3 with different adjusted volumes.
Figure 5:
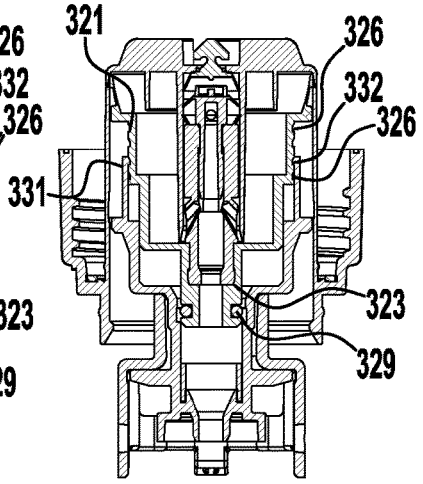
Figure 6:
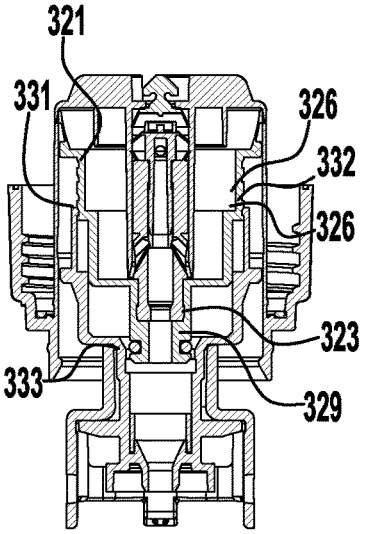

FIGS. 3-6 illustrate foam pump 210 with the mating relationship between piston holder 330 and air piston 320 arranged for producing different volumes of output per stroke. FIG. 3 illustrates the pump 210 arranged for the maximum dose size or volume size and actuator linkage 275 is configured for its maximum stroke length. FIG. 4 illustrates the pump 210 arranged for a slightly reduced volume dose size and actuator linkage 275 is configured for its slightly reduced stroke length. FIG. 5 illustrates the pump 210 arranged for a greater reduced volume dose size and actuator linkage 275 is configured for its greater reduced stroke length. FIG. 6 illustrates the pump 210 arranged for a minimum volume dose size and actuator linkage 275 is configured for its minimum stroke length.

In these exemplary embodiments, when the pumps 210 are configured for a reduced volume dose output, the volume of both the liquid chamber and the air chamber are both reduced. In addition, during operation, the liquid piston 310 is moved to its inward (or upward in this exemplary embodiment) most point so that the liquid pump chamber 308 is at is smallest volume when the pump is fully compressed when the dispense cycle is complete. Similarly, the air piston 320 moves to its inward (or upward in this exemplary embodiment) most point so that air chamber 324 is at is smallest volume when the dispense cycle is complete. Ensuring that the liquid chamber 308 is compressed to its smallest volume when the dispense cycle is complete, eliminates, or reduces the risk of, priming issues. During operation, many pumps that are modified to reduce the dispense volume have priming issues because the liquid pump chamber is not fully compressed when dispensing a reduced volume and air in the pump chamber may merely compress and decompress without drawing in liquid.

In some exemplary embodiments, refill unit 200 are shipped with pump 210 in the position illustrated in FIG. 6 with the pump 210 arranged for a minimum dose size. Pump 210 is placed in a dispenser and actuator linkage 275 engages piston holder 330. If the dispenser 100 is configured for actuator linkage 275 to dispense the minimum dose, actuator linkage 275 drives piston holder 330 upward and the physical relationship between piston holder 333 and air piston housing 322 remains that same. If however, dispenser 100 is configured for actuator linkage 275 to dispense a different size dose than the minimum, actuator linkage 275 drives piston holder 330 upward for its set actuator drive length. When air piston 320 and/or liquid piston 310 contact the top of housing 302 or another member, the air piston 320 and liquid piston 310 stop moving, piston holder 330 may continue to move with respect to air piston housing 222. As piston holder 330 continues to move with respect to air piston housing 22, the one or more projections 332 move upward with respect to the one or more grooves 326 that the one or more projections 332 were engaged with and the one or more projections 332 engage with one or more different grooves 326. Accordingly, depending on the set actuator drive length, foam pump 210 self-adjusts to the correct volume of which the dispenser actuator drive mechanism has been set.

As can be seen, in this exemplar embodiment, the configuration of the liquid piston 310 and the air piston 320 are arraigned so that both the liquid piston 310 and the air piston 320 move to their uppermost positions irrespective of the volume of the dose to be dispensed. In other words, the volume of the liquid pump chamber 308 and the air pump chamber 324 are always compressed to their smallest volumes when the actuator linkage 275 is at the end of its dispense stroke length. In each of FIGS. 3-6, the actuator linkage 275 is shown at the end of its dispense stroke length and in each of the figures, both the air pump chamber 324 and the liquid pump chamber 308 are at their smallest volumes.

During operation, the first dispense stroke causes foam pump 210 to automatically set its dose volume to the volume that the dispenser has been configured to dispense. Then as pistons 310, 320 move downward, liquid flows from the container 202 past one-way liquid inlet valve 304 into liquid pump chamber 308. As air pump chamber 324 expands, air is drawn in through outlet 336, through apertures 323 into air pump chamber 324.

When pistons 310, 320 move upward liquid flows from liquid pump chamber 308 past liquid outlet valve 313 through one or more apertures 314 into the center of liquid piston 310. Air flows from air pump chamber 324 through one or more apertures 323 into the center of piston 310 where the air and the liquid mix together. The liquid air mixture flows through mix media 338 and are dispensed out of outlet nozzle 336 as a rich foam.

Figure 7:
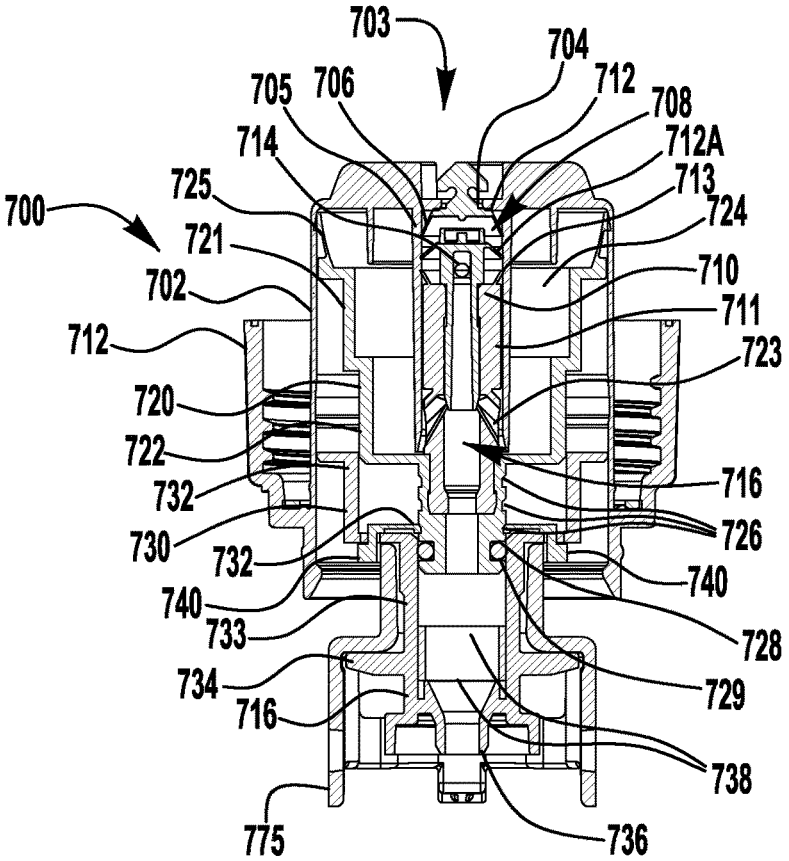
FIG. 7 is a cross-section of another exemplary embodiment of a pump with a self-adjusting volume output.

FIG. 7 is a cross-sectional view of the foam pump 700. Foam pump 700 includes a housing 702. Located within pump housing 702 is a cylindrical wall 705. Foam pump 700 includes a liquid inlet 703. Located within the liquid inlet 703 is a liquid inlet valve 704. Liquid inlet valve 704 has a wiper seal 706 that engages cylindrical wall 705. In this exemplary embodiment, liquid inlet valve 704 is a wiper valve, however, liquid inlet valve 704 may be any type of one-way valve, such as for example, a wiper valve, ball and spring valve, an umbrella valve, a flapper valve or the like.

A liquid piston 710 reciprocates within the cylindrical wall 705. Liquid piston 710 has a liquid outlet valve 712 located proximate its inner end. In this exemplary embodiment, liquid outlet valve 712 is a wiper valve, however, liquid outlet valve 712 may be any type of one-way valve, such as for example, a wiper valve, ball and spring valve, an umbrella valve, a flapper valve or the like. A pump chamber 708 is formed by liquid inlet valve 704, liquid outlet valve 712, and cylindrical wall 705.

Liquid pump piston 710 reciprocates back and forth increasing and decreasing the volume of liquid pump chamber 708. Liquid pump piston 710 includes a pair of opposed wiper seals 712A, 713, with wiper seal 712A being part of liquid outlet valve 712. In addition, liquid pump piston 710 has a hollow shaft and one or more apertures 714 between the opposed wiper seals 712A, 713 that allow liquid to flow from the liquid pump chamber 708 into the center of the liquid pump piston 710 toward outlet 736.

Foam pump 700 also includes an air pump chamber 724 and an air pump piston 720. Air pump piston 720 is connected to liquid pump piston 710 and accordingly, the two pistons 720, 710 move together. Air pump piston 720 includes a wiper seal 725 that rides against the inside wall of housing 702 to compress air in air chamber 724. Liquid pump piston 710 includes one or more air inlet apertures 714. Foam pump 700 includes two mix media 738, such as for example screens, that cause liquid flowing from foamable liquid container (not shown) through liquid pump piston 710 and air flowing from air pump chamber 724 through aperture 723 to mix together to form a rich foam. Other mix media, such as, for example, a porous member, one or more sponges, a plurality of baffles, or the like, may be used.

In addition, foam pump 700 includes an annular projection 734 for engaging with actuator linkage 775, which is connected to, and part of, the dispenser (not shown) to move the liquid piston 710 and air piston 720 upward to dispense foam and downward to recharge the air pump chamber 724 and liquid pump chamber 708. Air pump chamber 724 is recharged by drawing in air through the outlet nozzle 736 and air outlet aperture 723. Drawing air in through the outlet nozzle 736 also sucks back residual foam and fluid to help prevent dripping after dispensing a dose of foam.

In this exemplary embodiment, the air piston 720 connects to a piston holder 730. Piston holder 730 releasably connects to actuator linkage 775 to operate pump 700. In this exemplary embodiment, piston holder 730 includes one or more projection members 732 that are connected to release handles 740. The one or more projection members 732 are biased inward and engage with one or more grooves 726 in air piston housing 720. In some embodiments, the one or more projection members 732 are annular projection members. In some embodiments, the one or more projection members 732 extend at least partially around the circumference of the opening that receives the air piston housing 720. In some embodiments, the grooves have a sloped surface. In some embodiments, the one or more projection members 732 are biased inward by a biasing member. In some embodiments, the one or more projection members 732 are made of a resilient member and are naturally biased inward.

In some embodiments, release handles 740 are included and the release handles 740 may be manipulated to release the one or more projections 732 from the one or more grooves 726 and/or may be used to manually set the volume dose of the pump. In some embodiments, the one or more projections are located on the air piston 720 and the one or more grooves are located on piston holder 730. Preferably the one or more grooves 726 are arranged to provide for a plurality of different desired dose size volumes. The dose size volumes may be adjusted as described above.

In some exemplary embodiments, refill units (not shown) are shipped with pump 700 in the position illustrated in FIG. 7 with the pump 700 arranged for a minimum dose size. Pump 700 is placed in a dispenser (not shown) and actuator linkage 775 engages piston holder 730. If the dispenser 700 is configured for actuator linkage 775 to dispense the minimum dose, actuator linkage 775 drives piston holder 730 upward and dispenses the minimum volume dose of foam without changing the relationship between the piston holder 730 and the air piston housing 721. If however, dispenser 700 is configured for actuator linkage 775 to dispense a different size dose than the minimum volume, actuator linkage 775 drives piston holder 730 upward for its set actuator drive length. When air piston 720 or liquid piston 710 contact the top of housing 702 or another member, the air piston 720 and liquid piston 710 stop moving. The piston holder 730 continues to move with respect to the air piston 720 and air piston housing 721 and the one or more projections 732 move upward with respect to the one or more grooves 726 that the one or more projections 732 were engaged in and the one or more projections 732 subsequently engage with one or more different grooves 726. Accordingly, depending on the set actuator drive length, foam pump 700 self-adjusts to the desired volume of fluid to be dispensed. In some embodiments, the pump volume dispense size may be changed or adjusted manually.

In this exemplar embodiment, the configuration of the liquid piston 710 and the air piston 720 are arraigned so that both the liquid piston 710 and the air piston 720 move to their uppermost positions irrespective of the volume of the dose to be dispensed. In other words, the volume of the liquid pump chamber 708 and the air pump chamber 724 are always compressed to their smallest volumes when the actuator linkage 775 is at the end of its dispense stroke length.

During operation, the first dispense stroke causes foam pump 700 to automatically set its dose volume. Then as pistons 710, 720 move downward, liquid flows from the container (not shown) past one-way liquid inlet valve 704 into liquid pump chamber 708. As air pump chamber 724 expands, air is drawn in through outlet 736, through apertures 723 into air pump chamber 724.

When pistons 710, 720 move upward liquid flows from liquid pump chamber 708 past liquid outlet valve 713 through one or more apertures 714 into the center of liquid piston 710. Air flows from air pump chamber 724 through one or more apertures 723 into the center of piston 710 where the air and the liquid mix together. The liquid air mixture flows through mix media 738 and are dispensed out of outlet nozzle 736 as a rich foam.

Figure 8:
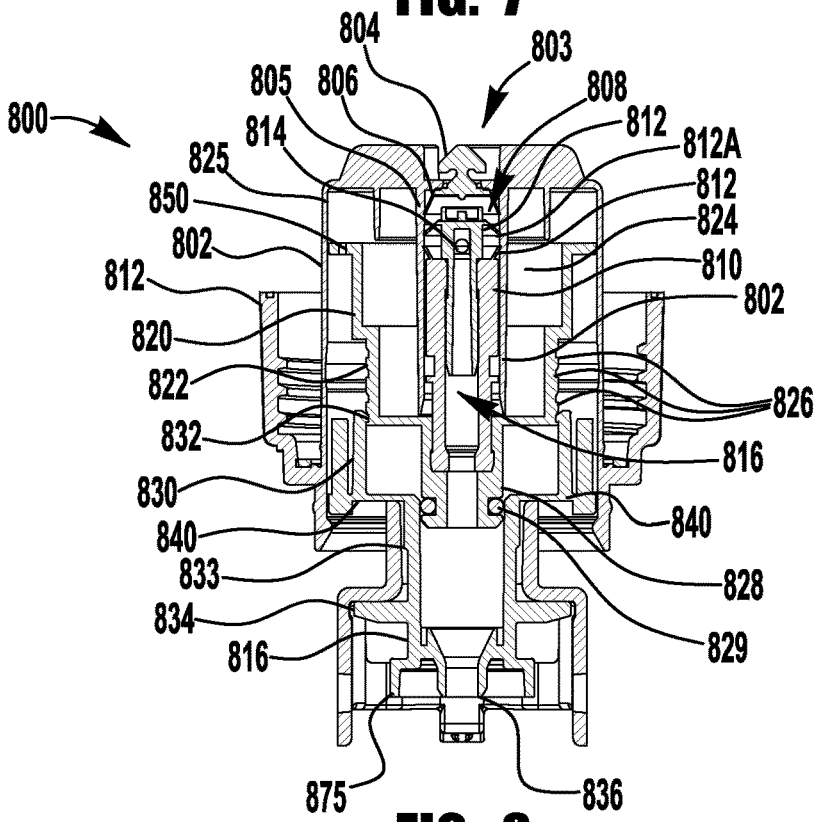
FIG. 8 is a cross-section of another exemplary embodiment a pump with a self-adjusting volume output.

FIG. 8 is a cross-sectional view a liquid pump 700. Liquid pump 800 includes many of the components of foam pump 700, however, liquid pump 800 includes one or more apertures 850 in air piston 820 to allow air in air pump chamber 824 to flow out of air pump chamber 824 and out of pump housing 802. In addition, piston 810 does not contain apertures that allow air to flow from air chamber 824 into the center of liquid piston 810. Liquid pump 800 includes a housing 802. Located within pump housing 802 is a cylindrical wall 805. Foam pump 800 includes a liquid inlet 803. Located within the liquid inlet 803 is a liquid inlet valve 804. Liquid inlet valve 804 has a wiper seal 806 that engages cylindrical wall 805. In this exemplary embodiment, liquid inlet valve 804 is a wiper valve, however, liquid inlet valve 804 may be any type of one-way valve, such as for example, a wiper valve, ball and spring valve, an umbrella valve, a flapper valve or the like A liquid piston 810 reciprocates within the cylindrical wall 805. Liquid piston 810 has a liquid outlet valve 812 located proximate its inner end. In this exemplary embodiment, liquid outlet valve 812 is a wiper valve, however, liquid outlet valve 812 may be any type of one-way valve, such as for example, a wiper valve, ball and spring valve, an umbrella valve, a flapper valve or the like. A pump chamber 808 is formed by liquid inlet valve 804, liquid outlet valve 812, and cylindrical wall 805.

Liquid pump piston 810 reciprocates back and forth increasing and decreasing the volume of liquid pump chamber 808. Liquid pump piston 810 includes a pair of opposed wiper seals 812A, 813, with wiper seal 812A being part of liquid outlet valve 812. In addition, liquid pump piston 810 has a hollow shaft and one or more apertures 814 between the opposed wiper seals 812A, 813 that allow liquid to flow from the liquid pump chamber 808 into the center of the liquid pump piston 810 toward outlet 836.

Foam pump 800 also includes an air chamber 824 and an air piston 820. Air piston 820 is connected to liquid pump piston 810 and accordingly, the two pistons 820, 810 move together. Air piston 820 includes one or more apertures 850. One or more apertures 850 in air piston 820 allow air to flow out to the air chamber 824 into the interior of housing 802 and out past piston holder 830. In this exemplary embodiment, there is no air passage between the air chamber 824 and the interior of piston 810.

Liquid pump 800 includes an annular projection 834 for engaging with actuator linkage 875, which is connected to the dispenser (not shown) to move the liquid piston 810 and air piston 820 upward to dispense liquid and downward to recharge the liquid pump chamber 808.

In this exemplary embodiment, the air piston 820 connects to a piston holder 830. Piston holder 830 releasably connects to actuator linkage 875 to operate pump 800. In this exemplary embodiment, piston holder 830 includes one or more projection members 832 that are connected to release handles 840. One or more projection members 832 are biased inward and engage with one or more grooves 826 in air piston housing 820. In some embodiments, the one or more projections are located on the air piston 820 and the one or more grooves are located on piston holder 830. Preferably the one or more grooves 826 are arranged to provide for desired dose sizes. The doses sizes may be adjusted as described above.

In some exemplary embodiments, refill units (not shown) are shipped with pump 800 in the position illustrated in FIG. 8 with the pump 800 arranged for a minimum dose size. Pump 800 is placed in a dispenser (not shown) and actuator linkage 875 engages piston holder 830. If the dispenser 800 is configured for actuator linkage 875 to dispense the minimum dose, actuator linkage 875 drives piston holder 830 upward and dispenses the minimum volume dose of liquid. If however, dispenser 800 is configured for actuator linkage 875 to dispense a different size dose than the minimum, actuator linkage 875 drives piston holder 830 upward for its set actuator drive length. When air piston 820 or liquid piston 810 contact the top of housing 802 or another member, the air piston 820 and liquid piston 810 stop moving, but because piston holder 830 continues to move, the one or more projections 832 move upward with respect to the one or more grooves 826 that the one or more projections 832 were engaged with and the one or more projections 832 engage with one or more different grooves 826. Accordingly, depending on the set actuator drive length, foam pump 800 self-adjusts to the volume to be dispensed, or can be adjusted manually.

During operation, the first dispense stroke causes pump 800 to automatically set its dose volume. Then as pistons 810, 820 move downward, liquid flows from the container (not shown) past one-way liquid inlet valve 804 into liquid pump chamber 808.

When pistons 810, 820 move upward liquid flows from liquid pump chamber 808 past liquid outlet valve 813 through one or more apertures 814 into the center of liquid piston 810 and is dispensed out of outlet nozzle 836 as a liquid.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

I claim:

1. A pump comprising:

a housing;

a liquid piston;

a liquid pump chamber;

an air piston;

an air pump chamber; and a piston holder;

the liquid piston is connected to the air piston;

the piston holder is movably connected to one of the liquid piston and the air piston;

wherein the movable connection comprises one or more first members and one or more second members;

wherein the one or more first members engage with the one or more second members in at least two positions; and wherein the volume of the liquid pump chamber and the air pump chamber in a first position are less than the respective volumes of the liquid pump chamber and the air pump chamber in a second position; and wherein when the liquid pump chamber and the air pump chambers are in their fully compressed positions, the volume of the liquid pump chamber in the first position is the same as the volume of the liquid pump chamber in the second position.

2. The refill unit of claim 1 wherein the one or more first members comprise one or more projections.

3. The refill unit of claim 2 wherein the one or more projections are on one of the air piston and the liquid piston.

4. The refill unit of claim 2 wherein the one or more projections are on the piston holder.

5. The refill unit of claim 1 wherein the one or more second members comprise one or more grooves.

6. The refill unit of claim 5 wherein the one or more grooves are on one of the air piston and the liquid piston.

7. The refill unit of claim 5 wherein the one or more grooves are on the piston holder.

8. The refill unit of claim 1 wherein the connection between the piston holder and one of the liquid piston and the air piston is moved from one of the first position to the second position or the second position to the first position by an actuator connected to a dispenser.

9. The refill unit of claim 1 wherein there are at least two grooves and the at least one projection engages a first groove to provide for a first volume in the liquid pump chamber and first volume in the air pump chamber or wherein the at least one projection engages a second groove to provide for a second volume in the liquid pump chamber and a second volume in the air pump chamber.

10. The refill unit of claim 1 further comprising a release member for causing the one or more first members and the one or more second members to disconnect from one another.

11. The refill unit of claim 1 wherein one of the one or more first members and the one or more second members are biased toward the other.

12. A refill unit for a soap, sanitizer or lotion comprising:
a container for holding a fluid;
a pump secured to the container;
the pump having
a housing;
a liquid piston;
a liquid pump chamber;
an air piston;
an air pump chamber; and
a piston holder;
the liquid piston is connected to the air piston;
one or more projections on one of the piston holder and the liquid piston and air piston;
one or more grooves on one of the piston holder and the liquid piston and air piston;
wherein a fully expanded volume of the air pump chamber and a fully expanded volume of the liquid pump chamber are determined by the position of the one or more projections with respect to the one or more grooves; and
wherein a fully compressed volume of the liquid pump chamber is constant.

13. The refill unit of claim 12 wherein the one or more grooves are on one of the air piston and the liquid piston.

14. The refill unit of claim 12 wherein the one or more projections are on the piston holder.

15. A dispenser system comprising;
a dispenser;
the dispenser having an actuator;
the dispenser having an actuator drive stroke length that may be set at one or more drive stroke lengths to dispense one or more different volumes of fluid;
refill unit for a soap, sanitizer or lotion;
the refill unit including a container for holding a fluid and a pump secured to the container;
the pump having
a housing;
a liquid piston;
a liquid pump chamber;
an air piston;
an air pump chamber; and
a piston holder;
the liquid piston is connected to the air piston;
one or more projections on one of the piston holder and the liquid piston and air piston;
one or more grooves on one of the piston holder and the liquid piston and air piston;
wherein the volume of the air pump chamber and the volume of the liquid pump chamber are determined by the position of the one or more projections with respect to the one or more grooves; wherein the position of the one or more projections with respect to the one or more grooves are determined by the one or more drive stroke lengths of the dispenser; and
wherein the fully compressed volume of the liquid pump is constant.

16. The refill unit of claim 15 wherein the one or more grooves are on the liquid piston.

17. The refill unit of claim 15 wherein the one or more projections are on the piston holder.

18. The refill unit of claim 15 wherein the one or more grooves are on the air piston.

19. The refill unit of claim 15 wherein the position of the one or more projections with respect to the one or more grooves are set by the actuator connected to the dispenser.

20. The refill unit of claim 15 wherein there are at least two grooves and the at least on projection engages a first groove to provide for a first volume in the liquid pump chamber and a first volume in the air pump chamber and wherein the at least one projection engages a second groove to provide for a second volume in the liquid pump chamber and a second volume in the air pump chamber.

* * * * *